US009380880B1

(12) United States Patent
Alexander

(10) Patent No.: US 9,380,880 B1
(45) Date of Patent: Jul. 5, 2016

(54) LEG BUDDY

(71) Applicant: Carol Alexander, Jersey City, NJ (US)

(72) Inventor: Carol Alexander, Jersey City, NJ (US)

( * ) Notice: Subject to any disclaimer, the term of this patent is extended or adjusted under 35 U.S.C. 154(b) by 0 days.

(21) Appl. No.: 14/492,239

(22) Filed: Sep. 22, 2014

(51) Int. Cl.
*A47C 4/00* (2006.01)
*A47C 16/02* (2006.01)

(52) U.S. Cl.
CPC ..... *A47C 16/02* (2013.01)

(58) Field of Classification Search
CPC ..... A47B 2003/0824; A47B 2003/0821; A47C 17/64; A47D 13/061
USPC ..... 297/16.2, 423.41; 5/110, 111, 305, 310, 5/99.1; 108/127
See application file for complete search history.

(56) References Cited

U.S. PATENT DOCUMENTS 131,696 A * 9/1872 Mathewson ..... A47F 5/02 135/147
180,732 A * 8/1876 Schapker ..... A47C 29/006 135/147
415,826 A * 11/1889 Turner ..... E04H 15/48 135/147
928,448 A * 7/1909 Hergelroth ..... E04H 15/48 135/144
1,325,164 A * 12/1919 Mowrey ..... A47B 3/04 108/34
1,588,391 A * 6/1926 Berry ..... E04H 15/48 135/147
2,875,008 A * 2/1959 Grodsky ..... A47B 1/00 108/141
2,889,186 A * 6/1959 Ferdinand ..... A47B 3/0815 108/160
3,136,272 A * 6/1964 Sprigman ..... A47C 4/286 108/118
3,638,588 A * 2/1972 Abbott ..... A47C 9/105 108/128
3,745,937 A * 7/1973 Gail ..... A47C 9/105 108/128
4,328,992 A 5/1982 Ohanian
4,991,325 A * 2/1991 Teduschi ..... D06F 81/04 108/116
5,044,690 A * 9/1991 Torrey ..... A47C 4/283 108/119
5,339,471 A * 8/1994 Lanzara ..... A47C 20/025 5/110
5,876,091 A 3/1999 Chernomashentsev
6,647,560 B1 * 11/2003 Hingley ..... A47K 11/06 297/16.2
6,857,246 B2 * 2/2005 Erbetta ..... E04H 15/36 135/124
6,892,744 B2 * 5/2005 Feldpausch ..... E04H 15/36 135/124
7,950,744 B2 5/2011 Hallamek
8,454,084 B2 * 6/2013 Lah ..... A47C 9/105 297/16.2
2008/0035822 A1 * 2/2008 Chen ..... A47B 3/0815 248/439
2009/0174233 A1 * 7/2009 Hoffman ..... A47C 4/286 297/16.2
2011/0067608 A1 3/2011 Eveleth
2012/0047649 A1 * 3/2012 Grace ..... A47C 17/64 5/110
2015/0089737 A1 * 4/2015 Ling ..... A47C 17/72 5/111

FOREIGN PATENT DOCUMENTS

IT WO 2008114305 A2 * 9/2008 ..... A45B 19/12

* cited by examiner

*Primary Examiner* — David R Dunn
*Assistant Examiner* — Alexander Harrison
(74) *Attorney, Agent, or Firm* — RG Patent Consulting, LLC; Rachel Gilboy

(57) ABSTRACT

The inventive device described in the instant application is a leg rest with collapsible capabilities. It is made with light weight metal and thin airy cloth to rest the user's legs on. It can be used by the user anywhere because of the devices collapsibility and portability it is an efficient and convenient way to transport a leg rest. It is emphasized that this abstract is provided to comply with the rules requiring an abstract that will allow a searcher or other reader to quickly ascertain the subject matter of the technical disclosure.

11 Claims, 3 Drawing Sheets

LEG BUDDY

CLAIM OF PRIORITY FROM RELATED APPLICATIONS

The present application claims priority from U.S. Provisional Patent Application No. 61/734,098 filed on Dec. 6, 2012 to Carol Alexander Porter Jersey City, (NJ) directed to the COLLAPSIBLE LEG REST that is hereby incorporated by reference. The inventor commonly refers to the collapsible head rest of the present application as the "Leg Buddy".

BACKGROUND OF THE INVENTION

1. Field of the Invention

The inventive device described in the instant application is a leg rest with collapsible capabilities. It is made with light weight metal and thin airy cloth to rest the users legs on. it can be used by the user anywhere because of the devices collapsibility and portability it is an efficient and convenient way to transport a leg rest.

2. Brief Description of the Prior Art

Foldable leg rest devices are well known in the art. Various Patents and Published Patent applications are in fact directed to text projectors. While developing the invention of the instant application independently the Inventor researched extensively the public record as well as the current market for portable leg rests and the most relevant examples found in the search are mentioned in the Information Disclosure Statement (IDS) attached.

Despite all the efforts listed above prior art patents describe structures that are either not truly convenient or else involve complicated, expensive, and overly difficult assembly and/or disassembly parts and procedures. Other devices have been advertised on various media but never patented or described into a printed publication.

SUMMARY OF THE INVENTION

The inventive device described in the instant application is a leg rest with collapsible capabilities. It is made with light weight metal and thin airy cloth to rest the user's legs on. It can be used by the user anywhere because of the devices collapsibility and portability it is an efficient and convenient way to transport a leg rest. The mechanism for the invention is a portable leg rest that folds open by with a canvas like material attached to the collapsible legs.

It is then the principal object of the present invention is to provide the user with a portable leg rest that can be used in any environment as readily as an umbrella.

It is a secondary objective of the present invention to provide user's with pain in their extremities a way to alleviate their pain.

It is an additional objective of the present invention to provide a device that does not rust or deteriorate over time. It is a final objective of the present invention to provide for a device that is relatively inexpensive to build, but that can eventually be sold at a premium.

These and other objective achieved by the device of the present invention will be apparent by the drawings, by their detailed description, and by the specification here from appended.

DESCRIPTION OF THE PREFERRED EMBODIMENT

Figure 1:
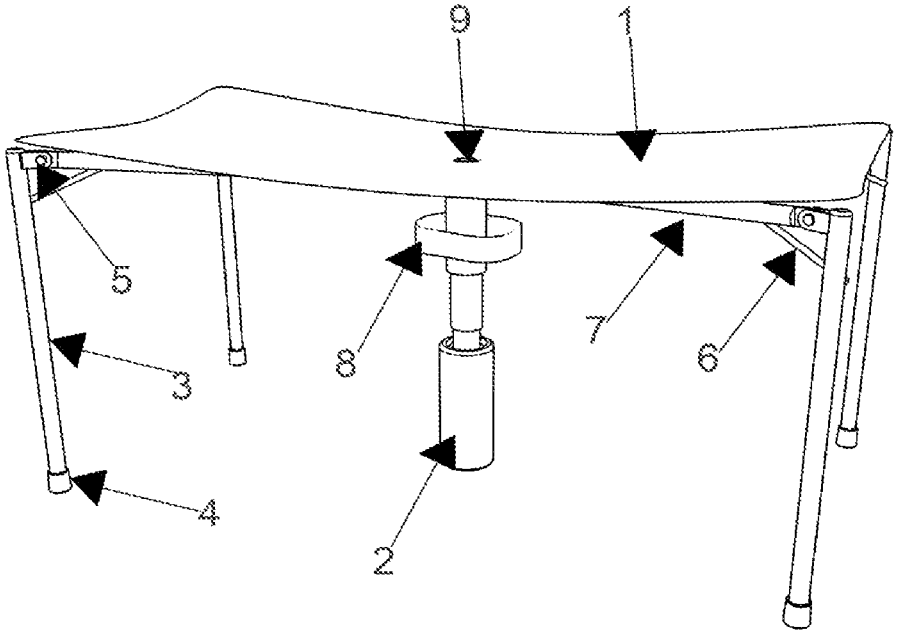
FIG. 1 is a front perspective view of one of the preferred embodiments of "Collapsible Leg Rest" in accordance with the teachings of the present invention.
Figure 2:
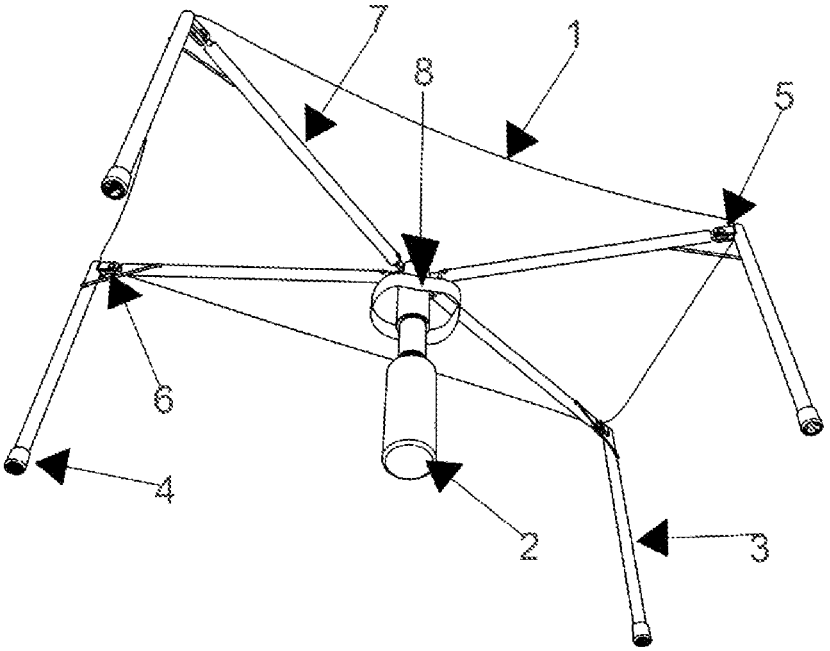
FIG. 2 is a bottom right perspective view of "Collapsible Leg Rest" of FIG. 1.
Figure 3:
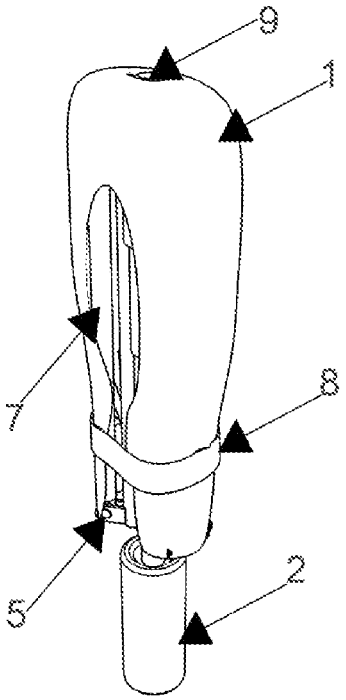
FIG. 3 is a left side perspective view of "Collapsible leg rest" of FIG. 1 in its collapsed configuration.

The inventive device described in the instant application is a leg rest with collapsible capabilities. It is made with light weight metal and thin airy cloth to rest the user's legs on. It can be used by the user anywhere because of the devices collapsibility and portability it is an efficient and convenient way to transport a leg rest. The mechanism for the invention is a portable leg rest that folds open by with a canvas like material attached to the collapsible legs and has a center leg for stability.

The Collapsible Leg Rest is designed to portable and a foldable way for users to have access to a leg rest in any environment This device can be used by any user that had pain in their extremities or doesn't. In one preferred embodiment of "Collapsible Leg Rest" of the present application will be either a larger or smaller leg rest with extendable capabilities The premise is to provide invention that is a leg rest for users who have pain in their extremities and need a leg rest to be readily available to alleviate the pain. The leg rest is portable thanks to its collapsible legs like that resemble the mechanism in an umbrella. This device will allow for the convenience of a leg rest to be used within any environment.

Users will have a convenient and efficient way of having a leg rest available in any instance. "Collapsible Leg Rest" provides a quick method to allow the user to alleviate any pain within their extremities by allowing them to raise their legs higher than their bodies.

A footstool (foot stool, footrest, foot rest) is a piece of furniture or a support used to elevate the foot. There are two main types of footstool, which can be loosely categorized into those designed for comfort and those designed for function. This type of footstool is used to provide comfort to a person seated, for example, in a chair or sofa. It is typically a short, wide, four-legged stool with a padded top, upholstered in a fabric or animal hide, such as leather. This type of footstool is also a type of ottoman. It allows the seated person to rest his feet upon it, supporting the legs at a mostly horizontal level, thus giving rise to use of the term footrest, for this item. And high quality footstool could adjust different height as personal will.

An umbrella or parasol is a canopy designed to protect against rain or sunlight. The word parasol usually refers to an item designed to protect from the sun; umbrella refers to a device more suited to protect from rain. Often the difference is the material; some parasols are not waterproof. Umbrellas and parasols are primarily hand-held portable devices designed to shield an individual from sun or rain, and are sized for personal use. Today, larger parasols are often used as fixed or semi-fixed devices, used with patio tables or other outdoor furniture, or as points of shade on a sunny beach. The collapsible (or folding) umbrella may have first been used in China and had sliding levers similar to those in use today.

A cement is a binder, a substance that sets and hardens as the cement dries and also reacts with carbon dioxide in the air dependently, and can bind other materials together. The word "cement" traces to the Romans, who used the term opus caementicium to describe masonry resembling modern concrete that was made from crushed rock with burnt lime as binder. The volcanic ash and pulverized brick additives that were added to the burnt lime to obtain a hydraulic binder were later referred to as cementum, cimentum, cäment, and cement. Cements used in construction can be characterized as being either hydraulic or non-hydraulic, depending upon the ability of the cement to be used in the presence of water (see hydraulic and non-hydraulic lime plaster). Non-hydraulic cement will not set in wet conditions or underwater, and is attacked by some aggressive chemicals after setting.

Canvas is an extremely heavy-duty plain-woven fabric used for making sails, tents, marquees, backpacks, and other items for which sturdiness is required. It is also popularly used by artists as a painting surface, typically stretched across a wooden frame. It is also used in such fashion objects as handbags, electronic device cases and shoes.

Aluminium (or aluminum; see spelling differences) is a chemical element in the boron group with symbol Al and atomic number 13. It is a silvery white, soft, ductile metal. Aluminium is the third most abundant element (after oxygen and silicon), and the most abundant metal in the Earth's crust. It makes up about 8% by weight of the Earth's solid surface. Aluminium metal is so chemically reactive that native specimens are rare and limited to extreme reducing environments. Instead, it is found combined in over 270 different minerals. The chief ore of aluminium is bauxite. Aluminium is remarkable for the metal's low density and for its ability to resist corrosion due to the phenomenon of passivation. Structural components made from aluminium and its alloys are vital to the aerospace industry and are important in other areas of transportation and structural materials. The most useful compounds of aluminium, at least on a weight basis, are the oxides and sulfates. Despite its prevalence in the environment, no known form of life uses aluminium salts metabolically. In keeping with its pervasiveness, aluminium is well tolerated by plants and animals. Owing to their prevalence, potential beneficial (or otherwise) biological roles of aluminium compounds are of continuing interest.

In one of its preferred embodiments the inventive device of the present application embodies a portable leg rest comprises: The canvas rest (1) that is stably held by the center leg (2) and is stretched over a plurality of foldable legs (3) that is held by a plurality of fastening means (4) such as hinges, or rubber stoppers. The foldable legs (3) are connected to a plurality of collapsing arms (7) by the metal hinge (5) and stabilized by the metal bar (6). The leg rest device is tied together with elastic wrap (8). The canvas rest (1) can be changed or washed thanks to the removable plastic cap (9).

In a separate preferred embodiment the portable leg rest of the present application comprises a band, such as a rubber band to keep it tight when it is in its collapsed configuration. Both said center leg, and said plurality of foldable legs are composed by a plurality of concentric tubes. Said tubes may be held in their extended configuration by a pin. In a separate preferred embodiment of the portable leg rest of the present application a plurality of internal springs are used to keep the central leg and said plurality of legs collapsed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible leg rest device comprising:

a frame including:

at least three collapsible arms;

wherein said at least three collapsible arms are pivotally attached at respective proximal ends to an elongated center leg and extend radially outwardly therefrom; and wherein each of said at least three collapsible arms are adapted to be locked in a position that forms a 90 degree angle with said elongated center leg;

wherein said elongated center leg is pivotally attached at a proximal end thereof to respective said proximal ends of said at least three collapsible arms;

at least three legs;

wherein said at least three legs are pivotally attached at proximal ends to respective distal ends of said at least three collapsible arms; and wherein each of said at least three legs are adapted to be locked in a position that forms a 90 degree angle with each respective said at least three collapsible arms, such that said at least three legs can be locked in a position that is parallel to said center leg; and a flexible fabric member;

wherein said flexible fabric member is removably attached to a portion of each said at least three legs, and is adapted to cover said at least three collapsible arms and said proximal end of said center leg; and wherein in a collapsed position said flexible fabric member substantially covers said at least three collapsible arms, said at least three legs, and said elongated center leg; and wherein in an in-use position said at least three collapsible arms are locked in a position that forms a 90 degree angle with said elongated center leg, said at least three legs are locked in a position that forms a 90 degree angle with each respective said at least three collapsible arms, and said flexible fabric member is stretched out and remains taught and adapted to hold the legs of a user in a horizontal position wherein said elongated center leg includes a ring member there around and extending from a center portion thereof, and forms a radius adapted such that when said collapsible leg rest device is in a folded position it is held in a particular shape to prevent damage when being stored.

2. The collapsible leg rest device of claim 1, wherein there are four said collapsible arms; and four said legs.

3. The collapsible leg rest device of claim 1, wherein said flexible fabric member is formed from canvas.

4. The collapsible leg rest device of claim 1, wherein each said at least three collapsible arms are connected to said elongated center leg via a respective hinge member; and wherein each said at least three legs are connected to each said at least three collapsible arms via a respective hinge member.

5. The collapsible leg rest device of claim 1, further comprising a rubber stopper at respective distal ends of each said at least three legs, and adapted to contact a surface said leg rest device is placed upon and increase friction therebetween to increase the stability of said leg rest device.

6. The collapsible leg rest device of claim 1, wherein said elongated center leg includes a cap on said proximal end to protect said flexible fabric member during use.

7. The collapsible leg rest device of claim 1, wherein said at least three collapsible arms, said at least three legs, and said elongated center leg are formed from aluminum.

8. The collapsible leg rest device of claim 1, wherein said at least three collapsible arms and said at least three legs are formed from aluminum; and wherein said elongated center leg is formed from plastic.

9. The collapsible leg rest device of claim 1, wherein said ring member is formed from plastic.

10. The collapsible leg rest device of claim 1, further comprising a stabilizer bar pivotally connected between each said at least three collapsible arms and their respective said at least three legs, and adapted such that when said collapsible leg rest device is in an in-use condition said stabilizer bars holds said collapsible arms and legs in position.

11. The collapsible leg rest device of claim 1, wherein said elongated center leg is positioned in an exact geometric center position between the at least three legs, such that in an in-use condition said collapsible leg rest device is adapted to rest more stably upon a floor surface.

* * * * *